US007092665B2

(12) United States Patent
Gomi et al.

(10) Patent No.: US 7,092,665 B2
(45) Date of Patent: Aug. 15, 2006

(54) FIXING APPARATUS HAVING AN EXFOLIATING MEMBER AND A RESTRICTING MEMBER

(75) Inventors: Katsuhito Gomi, Nagano (JP); Kazutoshi Fujisawa, Nagano (JP); Naoyuki Okumura, Nagano (JP); Shinichi Kamoshida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/727,985

(22) Filed: Dec. 5, 2003

(65) Prior Publication Data

US 2004/0170454 A1 Sep. 2, 2004

(30) Foreign Application Priority Data

Dec. 5, 2002 (JP) ..... P.2002-353750
Dec. 5, 2002 (JP) ..... P.2002-353751
Dec. 25, 2002 (JP) ..... P.2002-373942

(51) Int. Cl.
*G03G 15/20* (2006.01)

(52) U.S. Cl. ..... 399/323

(58) Field of Classification Search ..... 399/323, 399/322, 399

See application file for complete search history.

(56) References Cited

U.S. PATENT DOCUMENTS 4,370,051 A * 1/1983 Matsuyama et al. ..... 399/399
5,517,292 A * 5/1996 Yajima et al. ..... 399/323
6,205,316 B1 * 3/2001 Iida ..... 399/323
6,785,503 B1 * 8/2004 Kuo et al. ..... 399/323
2002/0131801 A1 * 9/2002 Tomatsu ..... 399/400
2002/0176726 A1 * 11/2002 Ohuchi et al. ..... 399/400
2003/0016971 A1 * 1/2003 Kikuchi et al. ..... 399/323
2003/0081970 A1 * 5/2003 Yamamoto et al. ..... 399/323

FOREIGN PATENT DOCUMENTS

JP 63182684 A * 7/1988
JP 05197305 A * 8/1993
JP 09-134090 A 5/1997
JP 09134090 A * 5/1997
JP 10097151 A * 4/1998
JP 11-184300 A 7/1999

* cited by examiner

*Primary Examiner*—Susan Lee
(74) *Attorney, Agent, or Firm*—Sughrue Mion, PLLC

(57) ABSTRACT

A fixing apparatus, includes a fixing roller which has a middle portion and both end portions in an axis direction thereof, a pressing roller which is brought into press contact with the fixing roller for rotating so that a press contact portion is formed, an exfoliating member which exfoliates a sheet-like record medium from a surface of the fixing roller after the record medium is passed through the press contact portion, and restricting members which is provided at both end portions of the exfoliating member, and is brought into contact with the surface of the fixing roller so that an interval between the surface of the fixing roller and the exfoliating member is restricted. The middle portion of the fixing roller is smaller than the both end portions of the fixing roller in a diameter. The restricting members are brought into contact with first portions of the fixing roller other than second portions of the fixing roller in which end edge portions of the pressing roller are brought into contact with the fixing roller.

12 Claims, 7 Drawing Sheets

FIXING APPARATUS HAVING AN EXFOLIATING MEMBER AND A RESTRICTING MEMBER

BACKGROUND OF THE INVENTION

The present invention relates to a fixing apparatus used in an image forming apparatus of a printer, a facsimile, a copier or the like for forming an image by using an electrophotography technology. Particularly, the invention relates to a restricting member for restricting an interval between a surface of a fixing roller and an exfoliating member of the image forming apparatus.

Also, the invention particularly relates to a technology of improving the exfoliating member.

Generally, an image forming apparatus using an electrophotography technology includes a photo conductive member having a photo conductive layer at an outer peripheral face thereof, a charging member for uniformly charging the outer peripheral face of the photo conductive member, an exposing member for forming an electrostatic latent image by selectively exposing the outer peripheral face uniformly charged by the charging member, a developing member for constituting a visible image (toner image) by providing a toner which is a developing agent to the electrostatic latent image formed by the exposing member, a transferring member for transferring the toner image developed by the developing member on a sheet-like record medium such as a sheet and a fixing apparatus for fixing the toner image onto the record medium transferred with the toner image by the transferring member.

The fixing apparatus includes a fixing roller driven to rotate and a pressing roller rotated by being brought into press contact with the fixing roller. The fixing roller has a heating member. The toner is melted to fix on the record medium by heating the record medium while passing the record medium through a press contact portion formed by the fixing roller and a pressing roller.

Further, since a face of the record medium, on which the toner image is fixed, liable to paste on the fixing roller by adhering operation of the toner, there is provided an exfoliating member for exfoliating and guiding the sheet-like record medium passing the press contact portion from a surface thereof.

JP-A-9-134090 discloses a first related fixing apparatus which includes a fixing roller 1 driven to rotate, a pressing roller 2 rotated by being brought into press contact with the fixing roller 1, an exfoliating member (wire member 11) provided to be proximate to the fixing roller 1 for exfoliating and guiding a sheet-like record medium S passing a press contact portion 3 of the fixing roller 1 and the pressing roller 2 from a surface of the fixing roller 1 and restricting members 12 provided at both end portions of the exfoliating member 11 for restricting an interval between a surface of the fixing roller 1 and the exfoliating member 11 by being brought into contact with both end portions of the fixing roller 1 in which outer side portions of the restricting members 12 are arranged on inner sides of end edge portions of the fixing roller 1. Especially, the first related fixing apparatus is disclosed in paragraphs 0011 through 0013, FIGS. 1 through 4 thereof.

According to JP-A-9-134090, although lengths of the fixing roller 1 and the pressing roller 2 are drawn to be the same, when the fixing apparatus is actually constituted, the lengths of the fixing roller 1 and the pressing roller 2 frequently differ from each other.

Further, although the fixing roller is preferably constituted by a gradual inverse crown shape (shape in which a diameter at a central portion thereof in an axis direction is slightly smaller than a diameter at both end portions thereof) in order to prevent a record medium from being wrinkled in the fixing operation, when the fixing roller is formed in the inverse crown shape, the following problem is found to pose.

For example, as shown in FIG. 7, when the fixing roller 1 is constituted by the inverse crown shape and the pressing roller 2 is brought into press contact with the fixing roller 1, an end edge portion 2*c* of the pressing roller 2 is most strongly brought into press contact with the fixing roller 1. Therefore, an abutment portion of the fixing roller 1 brought into contact with the roller end edge portion 2*c* of the pressing roller is most significantly worn to bring about a contact mark T1 in a ring-like shape. When a restricting member 12 is brought into contact with a portion of the contact mark T1, the contact state of the fixing roller 1 and the restriction member 12 becomes unstable.

Therefore, it has been found that the interval between the surface of the fixing roller and the exfoliating member is varied, operation of exfoliating the record medium by the exfoliating member is not carried out smoothly and jam (clogging of record medium) is brought about.

By the way, in a case that the fixing roller 11 has a constant diameter in an axis direction thereof and an outer side portion 12*a* of the restricting member 12 is arranged on an inner side of an end edge portion 1 a of the fixing roller 1 as shown in FIG. 8A, since the restricting member 12 restricts the interval between the exfoliating member 11 and the surface of the fixing roller by being brought into contact with the surface of the fixing roller 1, a contact portion of the surface of the fixing roller is gradually worn by press contact with the restricting member 12 although gradually while the fixing apparatus is operated. The worn portion is produced in a ring-like shape on the surface of the fixing roller as a contact mark. The contact mark is remarkable at portions in correspondence with the both side edge portions of the restricting member 12.

According to the related fixing apparatus shown in FIG. 8A, since an outer side portion 12*a* of the restricting member 12 is arranged on an inner side of an end edge portion 1*a* of the fixing roller 1, two streaks of contact marks T1' and T2' are produced at portions of the fixing roller 1 in correspondence with both side edge portions 12*a* and 12*b* of the restricting member 12.

Also, when the restricting member 12 is brought into contact with the fixing roller 1 having the inverse crown shape as shown in FIG. 8B, it is found that a contact mark T2 is produced at a portion of the fixing roller 1 in correspondence with the outer side portion 12*a* of the restricting member 12. Because a contact portion of the surface of the fixing roller is gradually worn by press contact with the restricting member 12 although gradually, and the worn portion is produced in a ring-like shape on the surface of the fixing roller as the contact mark T2. When the fixing roller 1 is contracted by a change in temperature of its own as shown in FIG. 8C, the restricting member 12 is slid relative to the fixing roller 1 on an outer side thereof in the axis direction as shown in from an imaginary line to a bold line. The restricting member 12 is brought into contact with a portion of the fixing roller 1 having a diameter larger than that of the case of FIG. 8B and therefore, the interval between the surface of the fixing roller and the exfoliating member is increased by an amount of $\Delta G$ which is an amount of a variation of the restricting member 12. As a result, operation of exfoliating the record medium by the exfoliating member is not carried out smoothly and jam (clogging of record medium) is brought about.

Meanwhile, JP-A-11-184300 discloses a second related fixing apparatus which includes a fixing roller driven to rotate, a pressing roller rotated by being brought into press contact with the fixing roller, an exfoliating sheet provided to the fixing roller for exfoliating and guiding a record medium in a sheet-like shape passing a press contact portion of the fixing roller and the pressing roller from a surface of the fixing roller and a support plate for supporting the exfoliating sheet.

Further, the exfoliating sheet has a base member comprised of a heat resistant resin or a metal and a fluororesin layer provided on a surface thereof. The support plate is constituted by a metal. Especially, the second related fixing apparatus is disclosed in paragraphs 0018, 0022 through 0024, FIGS. 1 and 2 thereof.

According to the second related fixing apparatus, the record medium is transported by the press contact portion of the fixing member and the pressing member while being heated and therefore, when the record medium is a medium including moisture of paper or the like, the moisture of the record medium is discharged from an outlet of the press contact portion as steam.

The steam is directed to an upper side, or when the fixing apparatus is provided with blowing device (or sucking device), the steam is directed to a downstream side of an airflow produced by the blowing device.

Therefore, when the exfoliating member is provided on the upper side of the outlet or on the downstream side of the air flow from the outlet of the press contact portion and the exfoliating member is at low temperatures (for example, the exfoliating member is at low temperatures at an initial stage of operating the fixing apparatus and thereafter, the temperature of the exfoliating member is gradually elevated by receiving heat from the fixing member or the like), dropwise condensation is brought about at a surface of the exfoliating member (guide face of the record medium).

The moisture condensed on the surface of the exfoliating member wets the record medium to thereby produce a wet mark on the record medium or bring about a strain of the record medium by the wetting.

Further, in the case of carrying out both faces printing of forming an image on the surface of the record medium and thereafter forming an image also on a rear face thereof, when the rear face side of the record medium is wetted in forming the image on the surface to fix and an image is going to be formed on the wetted rear face side, there is a case in which an electric property of the record medium is changed by wetting the record medium, a toner image cannot be transferred, or melting of the toner is hampered by the wet moisture to thereby bring about a significant defect in the image.

SUMMARY OF THE INVENTION

It is a first object of the invention to resolve the above-described problem and provide a fixing apparatus capable of being difficult to bring about jam.

Also, a second object of the invention is to resolve the above-described problem and provide a fixing apparatus in which a record medium is difficult to be wetted.

In order to achieve the first object, according to the present invention, there is provided a fixing apparatus comprising:

a fixing roller, having a middle portion and both end portions in an axis direction thereof, the middle portion being smaller than the both end portions in a diameter (an inverse crown shape);

a pressing roller, rotated by being brought into press contact with the fixing roller so that a press contact portion is formed;

an exfoliating member, exfoliating a sheet-like record medium from a surface of the fixing roller after the record medium is passed through the press contact portion; and restricting members, provided at both end portions of the exfoliating member, and brought into contact with the surface of the fixing roller so that an interval between the surface of the fixing roller and the exfoliating member is restricted, wherein the restricting members are brought into contact with first portions of the fixing roller other than second portions of the fixing roller in which end edge portions of the pressing roller are brought into contact with the fixing roller.

Preferably, an outer side portion of each of the restricting members is arranged on an outer side of each of both end edge portions of the fixing roller.

Preferably, a middle portion of each of the restricting members in an axis direction thereof is brought into contact with each of both end edge portions of the fixing roller.

According to the present invention, there is also provided a fixing apparatus, comprising:

a fixing roller, having a middle portion and both end portions in an axis direction thereof, the middle portion being smaller than the both end portions in a diameter;

a pressing roller, rotated by being brought into press contact with the fixing roller so that a press contact portion is formed;

an exfoliating member, exfoliating a sheet-like record medium from a surface of the fixing roller after the record medium is passed through the press contact portion; and restricting members, provided at both end portions of the exfoliating member, and brought into contact with the surface of the fixing roller so that an interval between the surface of the fixing roller an the exfoliating member is restricted, wherein an outer side portion of each of the restricting members is arranged on an outer side of each of both end edge portions of the fixing roller.

In the above configurations, the following operation and effect are achieved.

That is, since the fixing roller is formed in the inverse crown shape, the record medium passing the press contact portion of the fixing roller and the pressing roller is difficult to be wrinkled.

Further, since the restricting member is brought into contact with the first portion of the fixing roller other than the second portion of the fixing roller brought into contact with the end edge portion of the pressing roller and therefore, even when a contact mark (refer to T1 of FIG. 7) in a ring-like shape is produced at the portion of the fixing roller brought into contact with the end edge portion of the pressing roller, a state of bringing the restricting member into contact with the surface of the fixing roller becomes stable.

Therefore, according to the fixing apparatus, the interval between the surface of the fixing roller and the exfoliating member hardly changes and is maintained constant, operation of exfoliating the record medium by the exfoliating member is carried out smoothly and jam is difficult to be brought about.

Further, by arranging an outer side portion of the restricting member on an outer side of the end edge portion of the fixing roller, the following operation and effect are further achieved.

That is, the above-described restricting member 12 restricts the interval between the exfoliating member 11 and the surface of the fixing roller by being brought into contact with the surface of the fixing roller 1 and therefore, as the fixing apparatus is operated, the contact portion of the surface of the fixing roller is gradually worn by the contact with the restricting member 12 although gradually, and the worn portion is produced in the ring-like shape on the surface of the fixing roller as the contact mark of the restricting member 12. When the fixing roller is constituted by the inverse crown shape, the contact mark is remarkable at a portion thereof in correspondence with the outer side portion of the restricting member 12 (refer to T2 of FIGS. 8B and 8C).

Meanwhile, since the fixing roller is elongated and contracted by a change in temperature of its own, as shown in FIG. 8B, a contact mark T2 is produced at a portion of the fixing roller 1 in the inverse crown shape in correspondence with an outer side portion 12*a* of a restricting member 12 and thereafter, when the fixing roller 1 is contracted as shown in FIG. 8C, the restricting member 12 is slid relative to the fixing roller 1 on an outer side in an axis direction thereof as shown in from an imaginary line to a bold line and is brought into contact with a portion of the fixing roller 1 having a diameter larger than that in the case of FIG. 8B and therefore, the interval between the surface of the fixing roller and the exfoliating member is increased by an amount of $\Delta G$ which is an amount of a variation of the restricting member 12, operation of exfoliating the record medium by the exfoliating member is not carried out smoothly and jam is brought about.

In contrast thereto, when the outer side portion of the restricting member is arranged on the outer side of the end edge portion of the fixing roller, the outer side portion of the restricting member is not brought into contact with the fixing roller and a so-to-speak barrel portion (a face opposed to the fixing roller excluding both side edge portions) of the restricting member is brought into contact with the end edge portion of the fixing roller.

Therefore, the above-described large contact mark T2 is not produced.

Further, even when the fixing roller is contracted and the restricting member is slid relative to the fixing roller on the outer side in the axis direction, the restricting member is brought into contact with the end edge portion of the fixing roller still at the barrel portion.

Therefore, the interval between the surface of the fixing roller and the exfoliating member hardly changes and is maintained constant.

Therefore, operation of exfoliating the record medium by the exfoliating member is carried out further smoothly and jam is further difficult to be brought about.

In order to achieve the second object, according to the present invention, there is provided a fixing apparatus, comprising;

a fixing member, driven so as to rotate;

a pressing roller, rotated by being brought into press contact with the fixing roller so that a press contact portion is formed; and an exfoliating member, exfoliating a sheet-like record medium from at least one of a surface of the fixing roller and a surface of the pressing roller after the record medium is passed through the press contact portion, and guiding the recording medium, wherein the exfoliating member is provided on an upper side of an outlet of the press contact portion or a downstream side of an air flow from the outlet of the press contact portion; and wherein the exfoliating member is provided with a roller rotated in a direction of moving the record medium.

Preferably, the roller is shaped in either an abacus bead or a star wheel.

Preferably, the roller is comprised of a synthetic resin.

Preferably, a surface of the roller has a water repellency.

In the above configuration, the following operation and effect are achieved.

That is, since the exfoliating member is provided with the roller rotated in the direction of moving the record medium, an area of the record medium brought into contact with the exfoliating member can be reduced without hampering movement of the record medium.

Therefore, even when there is assumedly more or less dropwise condensation on the exfoliating member, the record medium is difficult to be brought into contact therewith, as a result, the record medium is difficult to be wetted and it is difficult to bring about a drawback that a wet mark or strain is produced or a significant effect in an image in both faces printing is brought about.

Further, when the roller is constituted by the shape of the abacus bead or the shape of the star wheel, an area of the roller per se brought into contact with the record medium can be reduced. Therefore, even when dropwise condensation is brought about on the roller per se, the record medium is made to be further difficult to be wetted and it is further difficult to bring about a drawback that a wet mark or strain is brought about on the record medium or a significant defect in an image in both faces printing is brought about.

Further, when the roller is made of a synthetic resin, since the heat conductivity of the synthetic resin is low, a surface temperature of the roller is liable to rise and dropwise condensation is difficult to be brought about on the surface per se of the roller. Therefore, the record medium is made to be further difficult to be wetted and it is further difficult to bring about a drawback that a wet mark or strain is produced on the record medium or a significant defect in an image in both faces printing is brought about.

Further, when the surface of the roller is provided with the water repellency, dropwise condensation is difficult to be brought about on the surface per se of the roller by the repellent operation. Therefore, the record medium is further mad to be difficult to be wetted and it is further difficult to bring about a drawback to produce a wet mark or strain on the record medium or produce a significant defect in an image in both faces printing.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Embodiments of the invention will be explained in reference to the drawings as follows.

Figure 1:
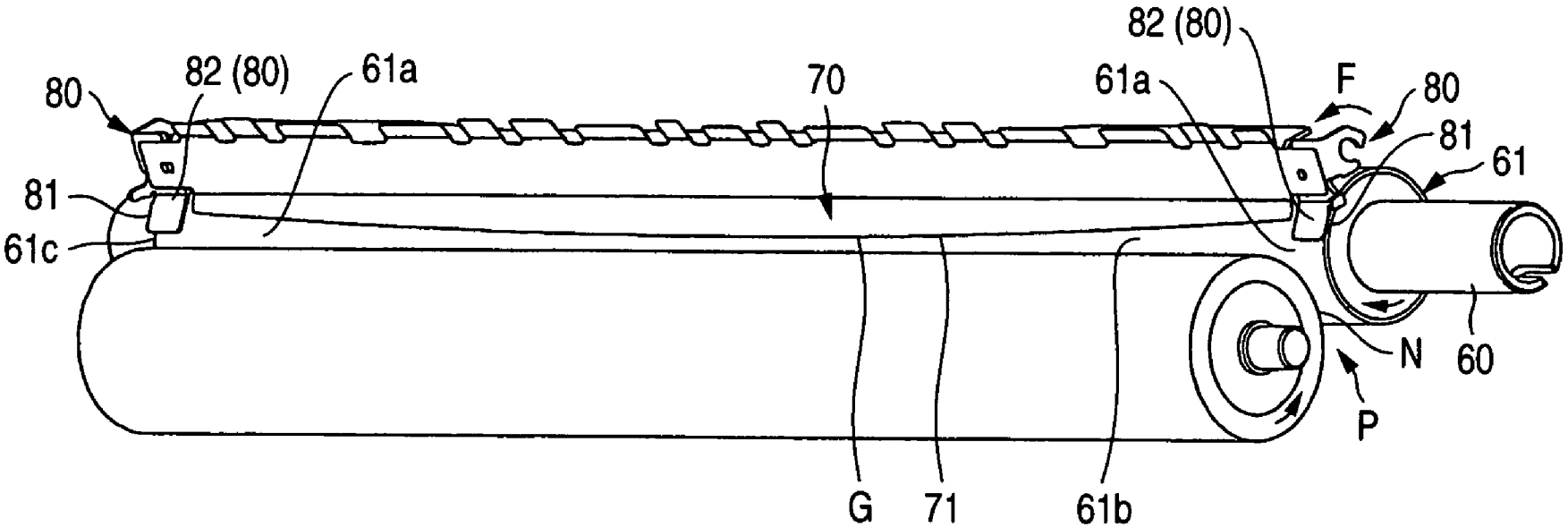
FIG. 1 is a perspective view showing a fixing apparatus according to a first embodiment of the invention.
Figure 2:
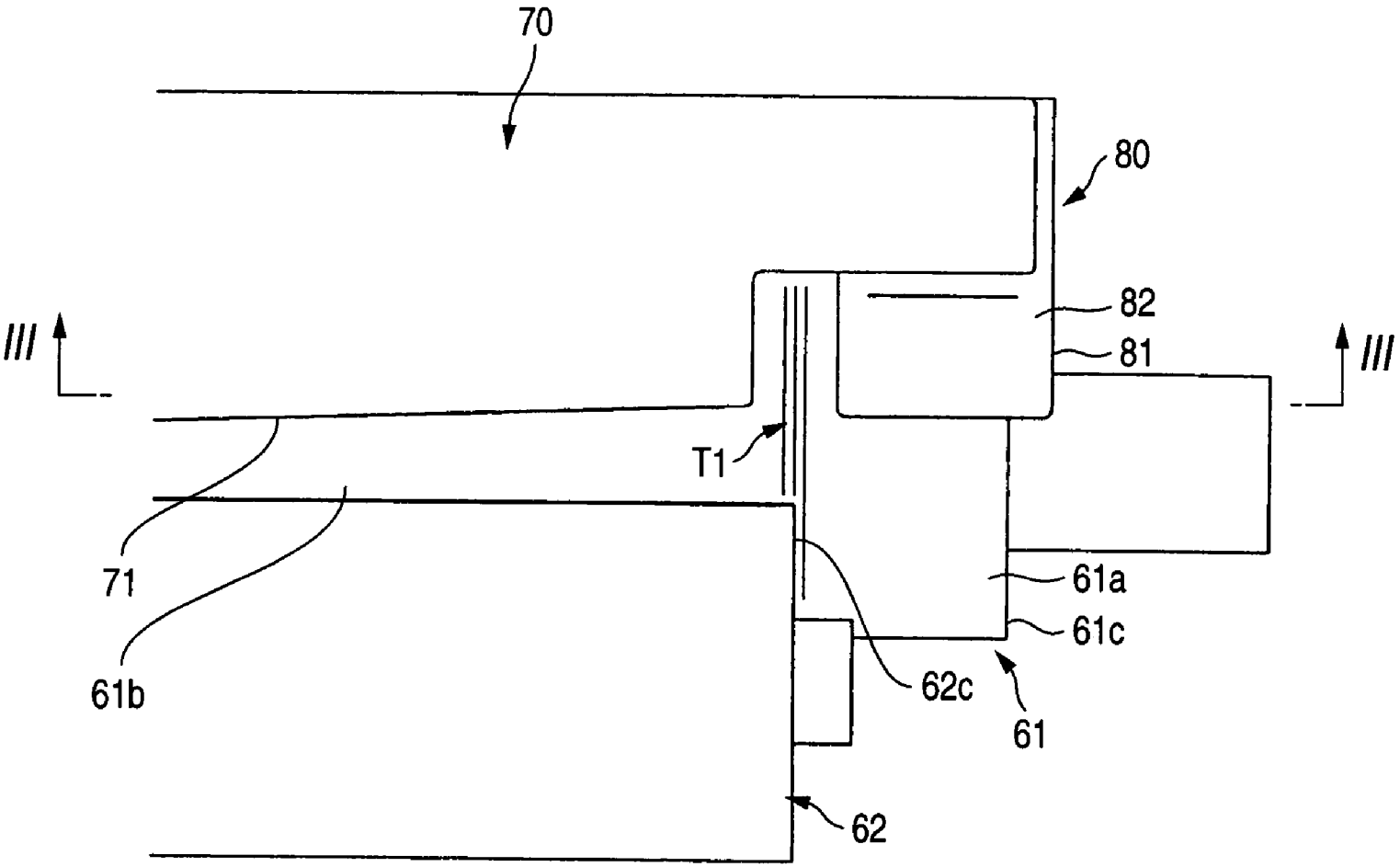
FIG. 2 is an outline plane view showing end portions of a fixing roller and an exfoliating member.
Figure 3:
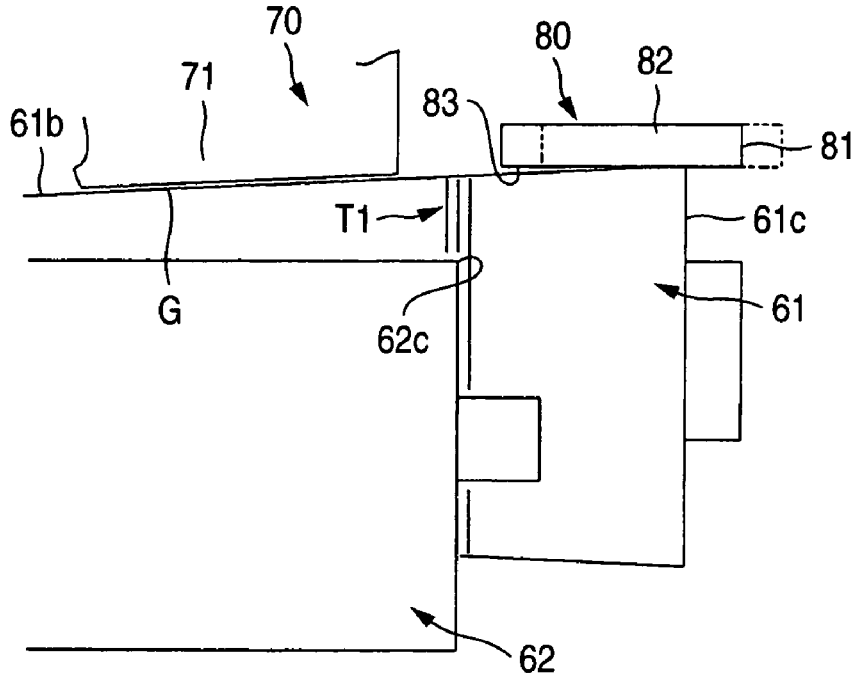
FIG. 3 is an outline sectional view taken along a line III—III of FIG. 2.

FIG. 1 is a perspective view showing a fixing apparatus according to a first embodiment of the invention, FIG. 2 is an outline plane view showing end portions of a fixing roller and an exfoliating member and FIG. 3 is an outline sectional view taken along a line III—III of FIG. 2.

A fixing apparatus according to the first embodiment of the present invention includes a fixing roller 61 having a heater 60 as a heating member, a pressing roller 62, an exfoliating member 70 and restricting members 80. The fixing roller 61 is driven to rotate by a drive mechanism (not illustrated). The pressing roller 62 is rotated by being brought into press contact with the fixing roller 61. The exfoliating member 70 is provided so as to be proximate to the fixing roller 61 for exfoliating and guiding a sheet-like record medium (not illustrated) which passes a press contact portion N formed by the fixing roller 61 and the pressing roller 62 as shown in an arrow mark P from a surface of the fixing roller 61. The restricting members 80 are provided at both end portions of the exfoliating member 70 for restricting an interval G between a surface 61*b* of the fixing roller 61 and the exfoliating member 70 by being brought into contact with the surface 61*b* of the fixing roller 61 at both end portions 61*a* of the fixing roller 61.

The fixing roller 61 is formed with a gradual inverse crown shape (shape in which a diameter of a central portion thereof in an axis direction is slightly smaller than a diameter of both end portions thereof) (refer to FIG. 3). The restricting member 80 is brought into contact with the fixing roller 61 at a contact portion which is other than a portion T1 thereof brought into contact with an end edge portion 62*c* of the pressing roller 62. In FIG. 3, the contact portion is located at an outer side in an axial direction of the fixing roller.

Further, an outer side portion 81 of the restricting member 80 is arranged on an outer side of the end edge portion 61*c* of the fixing roller 61.

Figure 4:
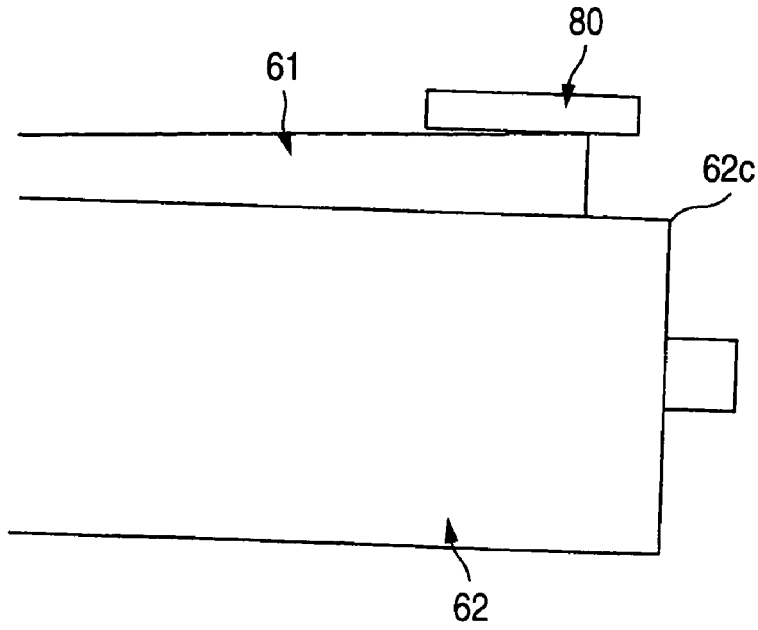
FIG. 4 is a partially omitted front view showing a modified example.

Although in FIG. 1 through FIG. 3, the pressing roller 62 is constituted to be shorter than the fixing roller 61, as shown in FIG. 4, by constituting the end edge portion 62*c* of the pressing roller 62 to prevent from being brought into contact with the fixing roller 61 by forming the pressing roller 62 longer than the fixing roller 61, the contact portion per se of the fixing roller 61 brought into contact with the end edge portion 61*c* of the pressing roller may be constituted not to be brought about.

Further, the fixing apparatus is constituted by an oilless fixer in which oil is not coated on the roller 61 and the roller 62.

The both end portions of the exfoliating member 70 are supported by the restricting members 80 and the restricting member 80 is attached to a frame, not illustrated, of the fixing apparatus.

A spring, not illustrated, is provided between the restricting member 80 and the frame of the fixing apparatus. The restricting member 80 and the exfoliating member 70 are urged in a direction shown by an arrow mark F of FIG. 1 (direction in which a front end edge 71 of the exfoliating member 70 is proximate to a surface of the fixing roller 61) by the spring. A portion 82 of the restricting member 80 is brought in contact with the surface 61*b* of the fixing roller 61 for restarting pivoting movement of the fixing roller 61, thereby, an interval G between the surface 61*b* of the fixing roller 61 and the front end edge 71 of the exfoliating member 70 is restricted.

The above described fixing apparatus includes the fixing roller 61 driven to rotate, the pressing roller 62 rotated by being brought into press contact with the fixing roller 61, the exfoliating member 70 provided to be proximate to the fixing roller 61 for exfoliating and guiding the sheet-like record medium passing the press contact portion N of the fixing roller 61 and the pressing roller 62 from the surface 61*b* of the fixing roller 61 and the restricting members 80 provided at the both end portions of the exfoliating member 70 for restricting the interval. G between the surface 61*b* of the fixing roller 61 and the exfoliating member 70 by being brought into contact with the surface 61*b* of the fixing roller 61. The fixing roller 61 is formed in the inverse crown shape. The restricting member 80 is brought into contact with the contact portion of the fixing roller 61 other than the portion of the fixing roller 61 brought into contact with the end edge portion 62*c* of the pressing roller 62. According to the fixing apparatus, the following operation and effect are achieved.

That is, since the fixing roller 61 is formed in the inverse crown shape, the record medium passing the press contact portion N of the fixing roller 61 and the pressing roller 62 is difficult to be wrinkled.

Further, since the restricting member 80 is brought into contact with the portion of the fixing roller 61 other than the portion of the fixing roller 61 brought into contact with the end edge portion 62*c* of the fixing roller 62, as shown in FIG. 2 and FIG. 3, even when a contact mark T1 in a ring-like shape is produced at the portion of the fixing roller 61 brought into contact with the end edge portion 62*c* of the pressing roller 62, a state of bringing the restricting member 80 into contact with the surface 61*b* of the fixing roller becomes stable.

Therefore, according to the fixing apparatus, the interval G between the surface 61*b* of the fixing roller and the exfoliating member 70 hardly changes and is maintained constant operation of exfoliating the record medium by the exfoliating member 70 is smoothly carried out and jam is difficult to be brought about.

Further, since the outer side portion 81 of the restricting member 80 is arranged on the outer side of the end edge portion 61*c* of the fixing roller 61, the following operation and effect are further achieved.

That is, as shown in FIG. 3, the outer side portion 81 of the restricting member 80 is not brought into contact with the fixing roller 61. A belly portion (a face opposed to the fixing roller excluding the both side edge portions 81) 83 of the restricting member 80 is brought into contact with the end edge portion 61*c* of the fixing roller 61.

Figure 8A:
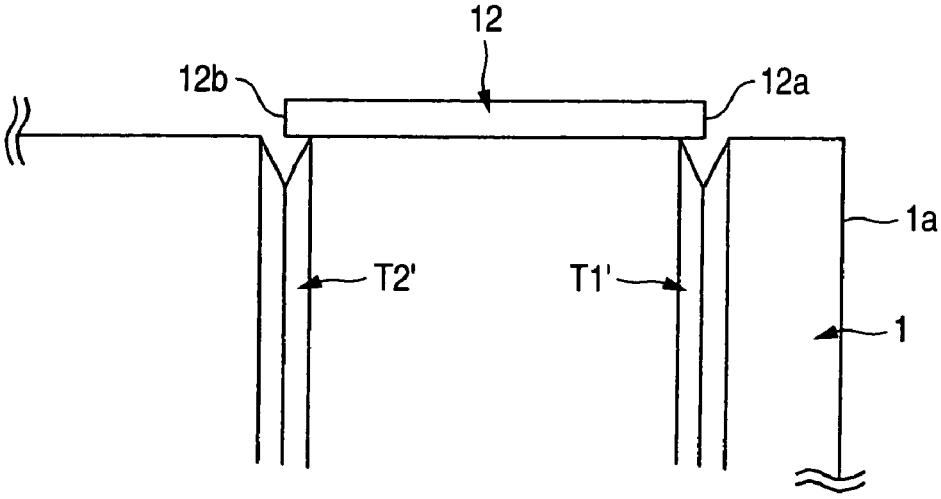
FIGS. 8A, 8B and 8C show a partially omitted front views showing a related fixing apparatus.
Figure 8B:
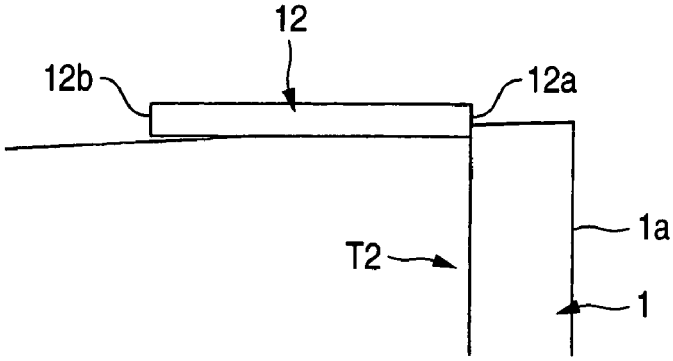
Figure 8C:
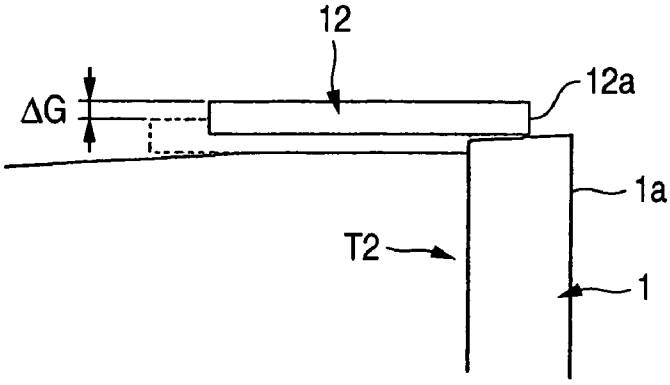

Therefore, according to the fixing apparatus, there is not brought about the contact mark T2 (refer to FIG. 8B) produced by bringing the outer side portion 81 of the restricting member 80 into contact with the fixing roller 61.

Further, even when the fixing roller 61 is contracted by a change in temperature of its own, and the restricting member 80 is slid relative to the fixing roller 61 on an outer side in an axis thereof as shown in from a bold line to an imaginary line of FIG. 3, the restricting member 80 is brought into contact with the end edge portion 61*c* of the fixing roller 61 still at the belly portion 83.

Therefore, the interval G between the surface 61*b* of the fixing roller and the exfoliating member 70 hardly changes and is maintained constant.

In the above configuration, according to the fixing apparatus, the operation of exfoliating the record medium by the exfoliating member 70 is further smoothly carried out and the jam is further difficult to be brought about.

Further, in a case that the end edge portion 62*c* of the pressing roller 62 is constituted not to be brought into contact with the fixing roller 61 by forming the pressing roller 62 longer than the fixing roller 61 as shown in FIG. 4, the contact portion per se of the fixing roller 61 in contact with the end edge portion 62*c* of the pressing roller is not brought about. Therefore, the above described contact mark T1 is not also produced. The interval G between the surface 61*b* of the fixing roller and the exfoliating member 70 becomes further stable, the operation of exfoliating the record medium by the exfoliating member 70 is carried out further smoothly and jam is further difficult to be brought about.

Figure 5:
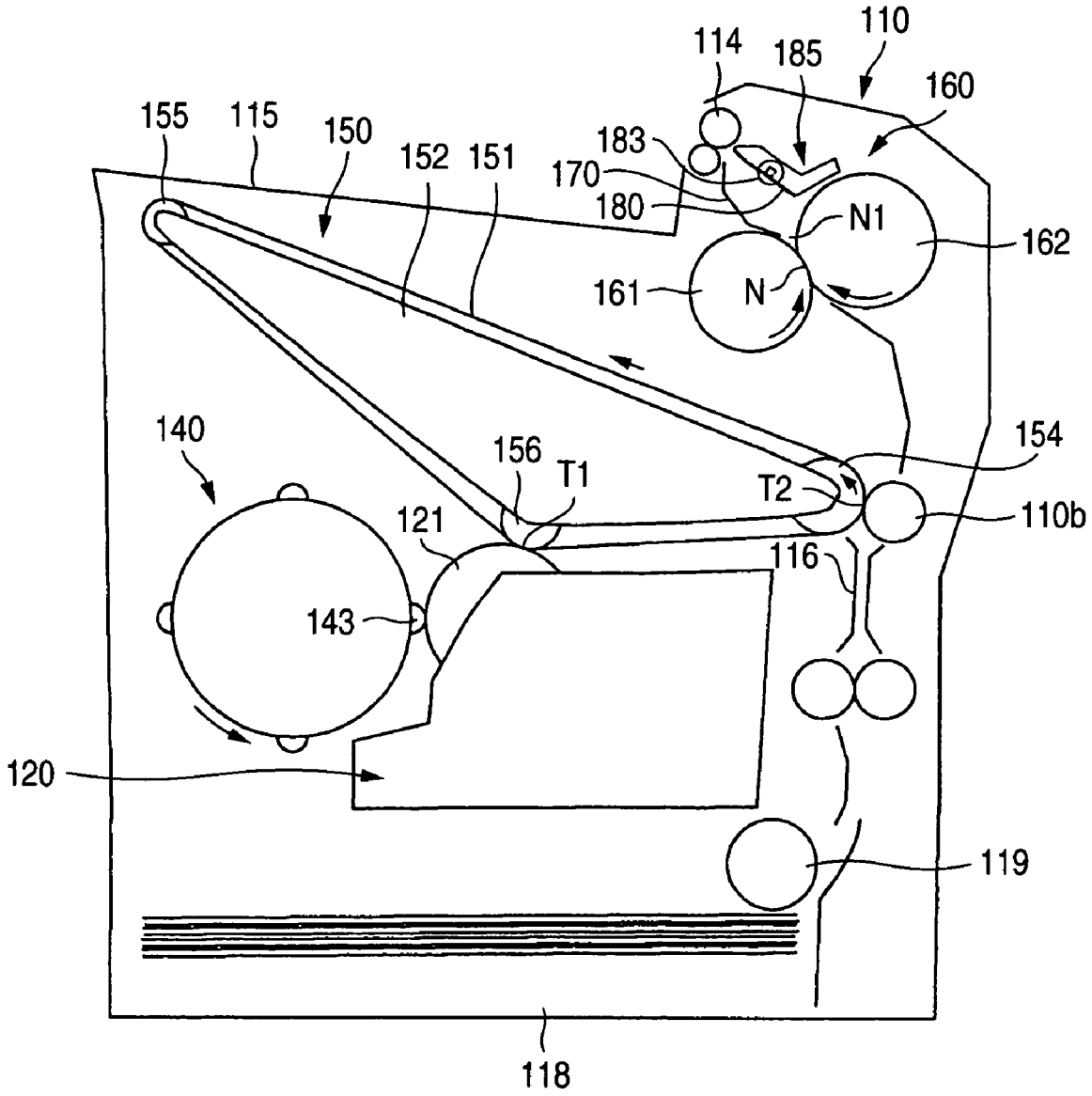
FIG. 5 is an outline side view showing an inner structure of an example of an image forming apparatus using a fixing-apparatus-according to a second embodiment of the invention.

FIG. 5 is an outline side view showing an inner structure of an image forming apparatus using a fixing apparatus according to a second embodiment of the invention.

The image forming apparatus is a color image forming apparatus capable of forming a full color image on both faces of sheet of A3 size (an example of a record medium), which includes a case 110, an image carrier and exposure unit 120, a developer 140 as developing member, a secondary transferring unit 150 and a fixing unit 160 which is a fixing apparatus contained at inside of the case 110.

The case 110 is provided with a frame of an apparatus main body, not illustrated, and the respective units and the like are attached to the frame.

The image carrier and exposure unit 120 includes a photo conductive member (image carrier) 121 having a photo conductive layer on an outer peripheral face thereof and charging member, not illustrated, for uniformly charging the outer peripheral face of the photo conductive member 121, an electrostatic latent image is formed by selectively exposing the outer peripheral face of the photo conductive member 121 uniformly charged by the charging member by laser light from the exposure unit, a visible image (toner image) is constituted by providing a toner which is a developing agent to the electrostatic latent image by the developer 140, the toner image is primarily transferred on a secondary transferring belt 151 of the secondary transferring unit 150 by a primary transferring portion T1 and secondarily transferred on a record is medium of sheet or the like which is an object of transcription by a secondary transferring portion T2.

Inside of the case 110 is provided with a transporting path for transporting the record medium formed with an image on one face thereof by the secondary transferring portion T2 to a sheet discharging portion (discharging tray portion) 15 at an upper face of the case 110 and a return path, not illustrated, for switching back sheet transported to the sheet discharging portion 115 by the transporting path to return to the secondary transferring portion T2 in order to form an image also on other face thereof.

A lower portion of the case 110 is provided with a sheet feeding tray 118 for laminating to hold a plurality of sheets and a sheet feeding roller 119 for feeding the sheets to the secondary transferring portion T2 sheet by sheet.

Th developer 140 is a rotary developer which can selectively develop a surface of the photo conductive member 121 by selectively bringing developing rollers 143 for respective colors into contact with the photo conductive member 121 by rotating the developer by a pitch of 90 degrees in an arrow mark direction.

The secondary transferring unit 150 includes a unit frame 152, a drive roller 154 and a driven roller 155 rotatably supported by the frame 152, a primary transcribing roller 156 and the secondary transferring belt 151 hung around to be stretched by the rollers and the belt 151 is driven to circulate in an illustrated arrow mark direction. The primary transferring portion T1 is formed between the photo conductive member 121 and the primary transcribing roller 156 and the secondary transferring portion T2 is formed at a press contact portion of the drive roller 154 and a secondary transcribing roller 110*b* provided on the main body side.

The secondary transferring roller 110*b* is separatable with respect to the drive roller 154, (that is, contact to and separate from the secondary transferring belt 151) and the secondary transferring portion T2 is formed when the secondary transferring roller 110*b* is brought into contact with the drive roller 154.

Therefore, in forming a color image, a color image is formed by overlapping a plurality of colors of toner images on the secondary transferring belt 151 in a state in which the secondary transferring roller 110*b* is separated from the secondary transferring belt 151, thereafter, the secondary transferring roller 110*b* is brought into contact with the secondary transferring belt 151 and the color image (toner image) is transferred onto the record medium by supplying the record medium to the contact portion (secondary transferring portion T2).

The record medium on which the toner Images are transferred is passed through the fixing unit (fixing apparatus) 160 so that the toner images are fixed by melting. The record medium is discharged to the discharge tray portion 15 by being transported by a pair of discharge rollers 14.

The fixing apparatus 60 according to the second embodiment includes a fixing roller 61 as a fixing member driven to rotate by a drive mechanism, not illustrated, a pressing roller 162 as a pressing member rotated by being brought into press contact with the fixing roller 161, an exfoliating member 170 of the fixing roller and an exfoliating member 180 for the fixing roller as exfoliating members provided to the fixing roller 161 and the pressing roller 162 for exfoliating and guiding a record medium (not illustrated) in a sheet-like shape passing a press contact portion N of the fixing roller 161 and the pressing roller 62 from a surface of the fixing roller 161 or the pressing roller 162.

According to the embodiment, toner images are formed on both faces of the record medium as described above and therefore, the exfoliating member (180) is provided also for the pressing roller 162, when the toner image is formed only on one face of the record medium, the exfoliating member (exfoliating member having a constitution, mentioned later) is provided only for a member on a side of providing a heat source.

As is apparent from FIG. 5, the exfoliating member 180 for the pressing roller is provided on an upper side of an outlet N1 of the press contact portion N of the fixing roller 161 and the pressing roller 162.

In the case of providing the exfoliating member 180 on the upper side of the outlet N1 of the press contact portion N, for example, in this way, when any measure is not assumedly taken at all, as described above, dropwise condensation is produced on a surface (guide face of record medium) 181 (refer to FIG. 6) of the exfoliating member 180 and the problem as described above is posed. Further, as described above, such a problem is posed even when the exfoliating member 80 is not provided on the upper side of the outlet N1 of the press contact portion N but is provided on a downstream side of an air flow from the outlet of the press contact portion N.

Hence, according to the embodiment, as shown in FIGS. 5 and 6, the exfoliating member 180 is provided with a roller 183.

Figure 6A:
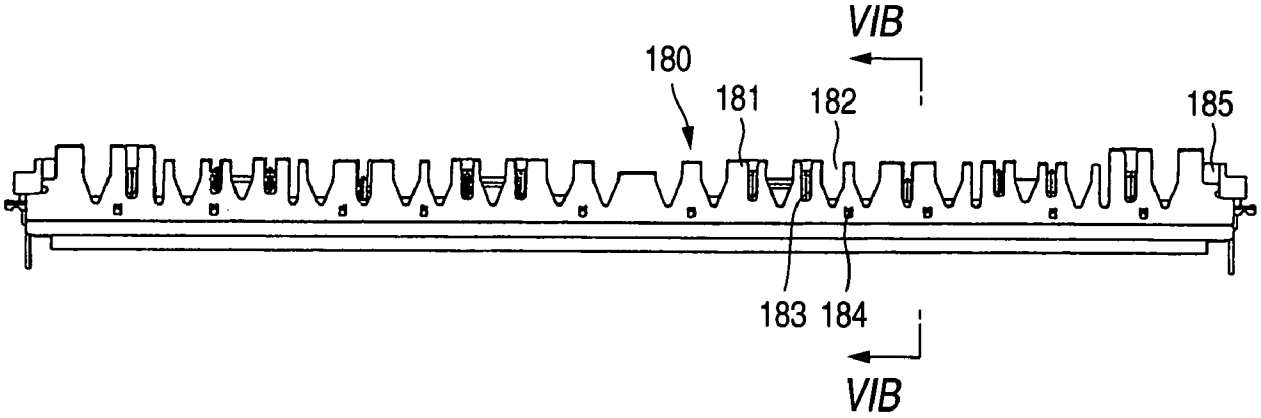
FIGS. 6A and 6B show a front view of an exfoliating member for a pressing roller and an enlarged sectional view taken along a line VIB—VIB of FIG. 6A.
Figure 6B:
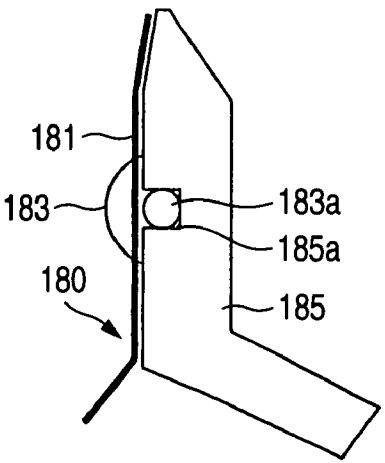
Figure 7:
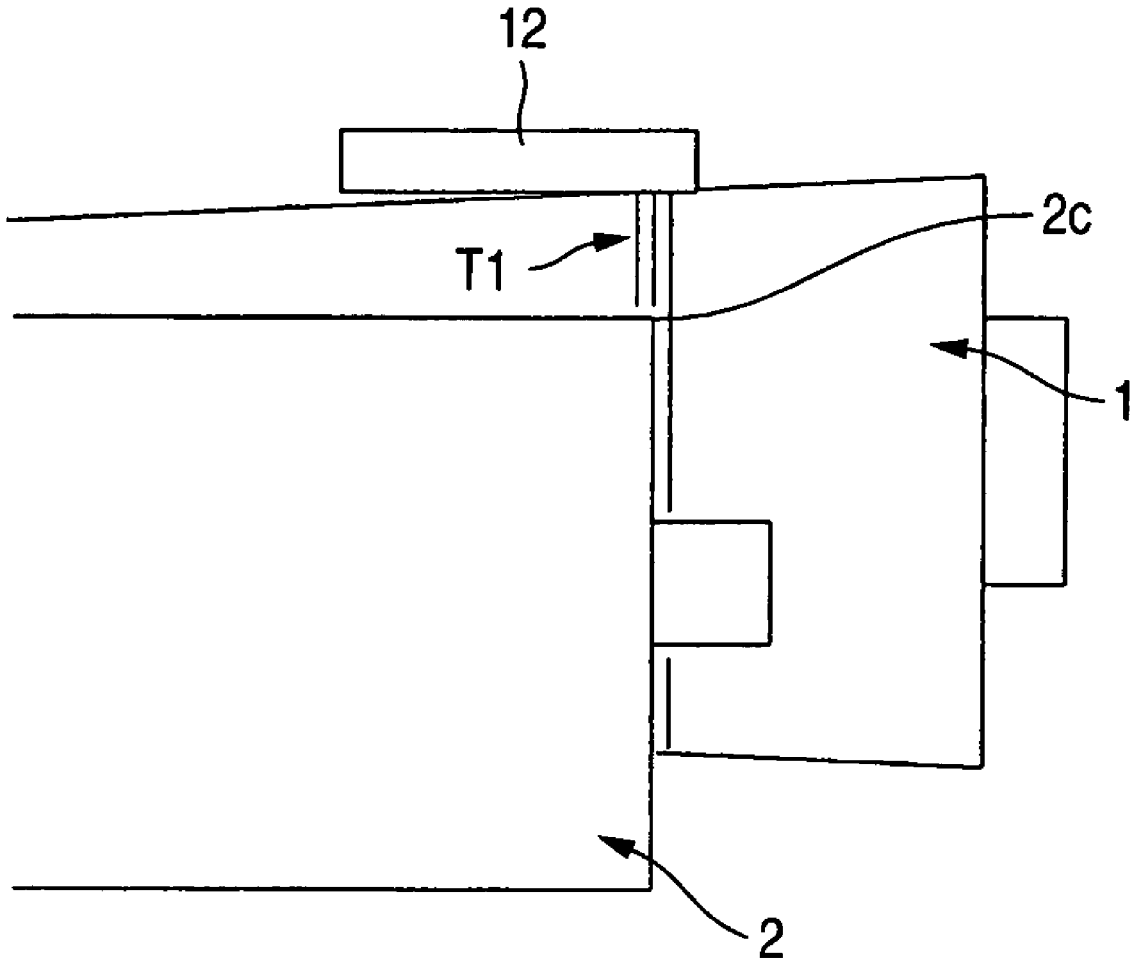
FIG. 7 is an outline plane view showing end portions of a fixing roller and an exfoliating member of a related fixing apparatus.

FIGS. 6A and 6B illustrate views showing the exfoliating member 180 for the pressing roller, FIG. 6A is a front view thereof and FIG. 6B is an enlarged sectional view taken along a line VIB of FIG. 6A.

The exfoliating member for the pressing roller (exfoliating member) 180 is formed in a L shape by folding to bend one sheet of a metal plate. Further, as shown in FIG. 6A, the exfoliating member 180 is partially formed with a notch hole 182. The guide face 81 for the record medium is coated with a synthetic resin (for example, fluororesin or the like of PEA or the like) excellent in exfoliating performance for a toner and having water repellency.

The notch hole 182 is formed by punching the metal plate from a side of the guide face 181 to a side of a rear face thereof. By punching the metal plate on the side of the guide face 181 to the side of the rear face, the side of the guide face 181 constitutes a press droop side (burr or the like produced by punching is disposed on the rear face side) and therefore, flatness of the guide face 81 is ensured.

A support member 185 is fixedly attached to the rear face side of the exfoliating member 80.

As shown in FIG. 6B, the roller 183 is provided with a shaft 183*a* and the support member 185 is provided with a recessed portion 185*a* for bearing. The roller 183 is attached to the exfoliating member 180 and the support member 185 rotatably (and therefore, rotatably in a direction of moving the record medium) by rotatably fitting the shaft 183*a* to the recess portion 185*a* of the support member 185 and fixedly attaching the exfoliating member 180 to the support member 185 to close the recess portion 185.

Although the roller 183 is constituted by a shape of an abacus bead, the roller 83 can also be constituted by a shape of star wheel.

Further, the roller 183 is preferably made of a synthetic resin, further preferably, constituted by a synthetic resin excellent in exfoliating performance for a toner and having water repellency (for example, fluororesin or the like of PEA or the like). It is preferable that at least a surface of the roller 183 is provided with water repellency. For example, the surface of the roller 183 is coated with a synthetic resin excellent in exfoliating performance for a toner and having water repellency (for example, fluororesin or the like of PEA or the like).

As shown in FIG. 6A, the roller 183 is provided on a downstream side in the direction of moving the record medium at the guide face 181 of the exfoliating member 180 and a projection 184 is provided on an upstream side of the guide face 181.

Further, both ends of the support member 185 are attached to a frame, not illustrated, of the fixing apparatus 160.

The above described fixing apparatus includes the fixing member 161 driven to rotate, the pressing member 162 rotated by being brought into press contact with the fixing member 161, and the exfoliating members 170 and 180 provided to the fixing member 161 and the pressing member 162 for exfoliating and guiding the record medium in the sheet-like shape passing the press contact portion N of the-fixing member 161 and the pressing member 162 from the surface of the pressing member 162, in which the exfoliating member 180 is provided on the upper side of the outlet N1 of the press contact portion N (or a downstream side of an air flow from the outlet of the press contact portion), the exfoliating member 180 is provided with the roller 183 rotated in the direction of moving the record medium and therefore, according to the fixing apparatus, the following operation and effect are achieved.

That is, since the exfoliating member 180 is provided with the roller 183 rotated in the direction of moving the record medium, an area of the record medium brought into contact with the exfoliating member 180 can be reduced without hampering movement of the record medium.

Therefore, even when there is assumedly more or less dropwise condensation on the guide face 181 of the exfoliating member 180, the record medium is made to be difficult to be brought into contact therewith, as a result, the record medium is made to be difficult to be wetted and it is difficult to bring about a drawback that the record medium is produced with a wet mark or strain or a significant defect in an image in both faces printing is brought about.

Further, since the roller 183 is shaped in the abacus bead or the star wheel, an area in which the roller 183 is brought into contact with the record medium can be reduced (line contact or point contact is constituted). Therefore, even when the dropwise condensation is brought about on the roller 183, the record medium is made to be further difficult to be wetted and it is further difficult to bring about a drawback that a wet mark or strain is brought about in the record medium or a significant defect in an image in both faces printing is brought about.

Further, by constituting the roller 183 by a synthetic resin, the surface temperature of the roller 183 is further liable to rise since the heat conductivity of the synthetic resin is low and dropwise condensation is made to be difficult to be brought about on the surface per se of the roller 183. Therefore, the record medium is made to be further difficult to be wetted, it is further difficult to bring about a drawback that a wet mark or strain is brought about at the record medium or a significant defect in an image in both faces printing is brought about.

Further, since the surface of the roller 183 is provided with water repellency, dropwise condensation is made to be difficult to be brought about on the surface of the roller 83 by the water repellent operation. Therefore, the record medium is made to be further difficult to be wetted and it is further difficult to bring about a drawback that a wet mark or strain is brought about on the record medium or a significant defect in an image in both faces printing is brought about.

Further, since the exfoliating member 180 has the 182, a sufficient air flow is blown in a surrounding of the exfoliating member 180 although the exfoliating member 180 is provided on the upper side of the outlet of the press contact portion N1 (or on the downstream side of the air flow from the outlet of the press contact portion). Therefore, steam discharged from the outlet N1 of the press contact portion N escapes from the surrounding of the exfoliating member 180, or a density of steam is thinned and therefore, dropwise condensation is made to be difficult to be brought about on the surface 181 of the exfoliating member 180.

Further, since the guide face 181 of the exfoliating member 180 is provided with the projection 184, the record medium is made to be further difficult to be brought into contact with the guide face 181 of the exfoliating member 180.

As a result, according to the fixing apparatus, the record medium is made to be further difficult to be wetted and it is further difficult to bring about a drawback that a wet mark or stain is brought about on the record medium or a significant defect in an image in both faces printing is brought about.

Although an explanation has been given of the embodiment of the invention as described above, the invention is not limited to the above embodiments but can pertinently be modified within the range of the gist of the invention.

For example, the invention is applicable also when the fixing member 61 is a belt.

What is claimed is:

1. A fixing apparatus, comprising:

a fixing roller, having a middle portion and both end portions in an axis direction thereof, the middle portion being smaller than the both end portions in a diameter;

a pressing roller, rotated by being brought into press contact with the fixing roller so that a press contact portion is formed;

an exfoliating member, exfoliating a sheet-like record medium from a surface of the fixing roller after the record medium is passed through the press contact portion; and restricting members, provided at both end portions of the exfoliating member, and brought into contact with the surface of the fixing roller so that an interval between the surface of the fixing roller and the exfoliating member is restricted, wherein an outer edge portion of each of the restricting members is arranged outside of each of both end edge portions of the fixing roller in the axial direction.

2. The fixing apparatus as claimed in claim 1, wherein a middle portion of each of the restricting members contacts each of the end edge portions of the fixing roller.

3. A fixing apparatus, comprising:

a fixing roller, having a middle portion and both end portions in an axial direction thereof, the middle portion being smaller than the both end portions in a diameter;

a pressing roller, rotated by being brought into press contact with the fixing roller so that a press contact portion is formed;

an exfoliating member, exfoliating a sheet-like record medium from a surface of the fixing roller after the record medium is passed through the press contact portion; and restricting members, provided at both end portions of the exfoliating member, and brought into contact with the surface of the fixing roller so that an interval between the surface of the fixing roller and the exfoliating member is restricted, wherein both end portions of the fixing roller extend beyond respective end portions of the pressing roller in the axial direction, such that the extended end portions of the fixing roller are outside the press contact portion, and wherein the restricting members are brought into contact with the extended end portions of the fixing roller which are outside the press contact portion.

4. The fixing apparatus as set forth in claim 3, wherein an outer edge portion of each of the restricting members is arranged outside of each of both end edge portions of the fixing roller in the axial direction.

5. The fixing apparatus as set forth in claim 3, wherein a middle portion of each of the restricting members in an axis direction thereof is brought into contact with each of both end edge portions of the fixing roller.

6. An apparatus, comprising:

a first roller;

a second roller that rotates in a press-contact relationship with the first roller, wherein a recording medium passes between the first roller and the second roller;

an exfoliating member comprising an exfoliating device and a restricting member, wherein the exfoliating device contacts the recording medium to remove the recording medium from a surface of the first roller after the recording medium passes between the first roller and the second roller, wherein the restricting member contacts a first region of the surface of the first roller to control the distance between the surface of the first roller and the exfoliating device and does not contact a second region, wherein the second roller contacts the second region of the surface of the first roller and does not contact the first region, wherein both end portions of the first roller extend beyond respective end portions of the second roller in a longitudinal axial direction, such that the extended end portions of the first roller comprise the first region of the surface when viewed along the longitudinal axial direction of the first roller.

7. The apparatus as claimed in claim 6, wherein a diameter of the first roller at the second region is smaller than a diameter of the first roller at the first region.

8. The apparatus as claimed in claim 6, wherein the second roller is driven by the rotation of the first roller.

9. The apparatus as claimed in claim 6, wherein a side edge of the restricting member, which is farthest from the second region of the first roller is located farther from the second region than an end edge of the first roller.

10. The apparatus as claimed in claim 9, wherein the end edge of the first roller is substantially perpendicular to the longitudinal axial direction.

11. The apparatus as claimed in claim 6, wherein a middle portion of the restricting member, in the longitudinal axis direction of the first roller, contacts a side edge of the first roller, wherein the side edge is angled with respect to the longitudinal axis direction.

12. The apparatus as claimed in claim 6, wherein the first roller is a fixing roller comprising a heater, and wherein the second roller is a pressing roller.

* * * * *